US008919331B2

(12) United States Patent
Rennert

(10) Patent No.: US 8,919,331 B2
(45) Date of Patent: Dec. 30, 2014

(54) PORTABLE AND ADJUSTABLE CLAY TARGET LAUNCHING APPARATUS

(71) Applicant: Casey Clarence Rennert, Manitowoc, WI (US)

(72) Inventor: Casey Clarence Rennert, Manitowoc, WI (US)

( * ) Notice: Subject to any disclaimer, the term of this patent is extended or adjusted under 35 U.S.C. 154(b) by 0 days.

(21) Appl. No.: 13/686,570

(22) Filed: Nov. 27, 2012

(65) Prior Publication Data

US 2013/0133636 A1 May 30, 2013

Related U.S. Application Data

(60) Provisional application No. 61/629,800, filed on Nov. 29, 2011.

(51) Int. Cl.

| | |
|---|---|
| ***F41J 9/18*** | (2006.01) |
| ***F41A 23/00*** | (2006.01) |
| *F41J 9/30* | (2006.01) |

(52) U.S. Cl.

CPC ..... *F41J 9/18* (2013.01); *F41J 9/30* (2013.01)
USPC ..... 124/8; 124/1; 124/6; 124/9; 124/81; 224/519

(58) Field of Classification Search

CPC ..... F41J 9/18; F41J 9/30
USPC ..... 124/1, 6, 8, 81, 9; 224/519; 248/694
See application file for complete search history.

(56) References Cited

U.S. PATENT DOCUMENTS

| | | | | |
|---|---|---|---|---|
| 3,070,082 | A * | 12/1962 | Foster | 124/8 |
| 3,937,203 | A * | 2/1976 | Riedmueller et al. | 124/8 |
| 4,014,310 | A * | 3/1977 | Laporte et al. | 124/6 |
| 4,077,384 | A * | 3/1978 | Montefeltro | 124/1 |
| 4,481,932 | A * | 11/1984 | Olson | 124/8 |
| 4,508,093 | A * | 4/1985 | Bertini | 124/1 |
| 5,249,563 | A * | 10/1993 | Patenaude | 124/8 |
| 5,947,475 | A * | 9/1999 | Skeuse et al. | 273/363 |
| 6,062,207 | A * | 5/2000 | Underhill | 124/8 |
| 6,176,229 | B1 * | 1/2001 | Patenaude | 124/8 |
| 6,227,517 | B1 * | 5/2001 | Wohl | 248/694 |
| 6,871,440 | B2 * | 3/2005 | Highfill et al. | 42/94 |
| 7,066,365 | B2 * | 6/2006 | Brown | 224/401 |
| 7,263,986 | B2 * | 9/2007 | Lovell | 124/9 |
| 7,637,255 | B1 * | 12/2009 | Freeland | 124/7 |
| 2003/0205599 | A1 * | 11/2003 | Brown | 224/401 |
| 2004/0049966 | A1 * | 3/2004 | Highfill et al. | 42/94 |
| 2006/0065258 | A1 * | 3/2006 | Lovell | 124/9 |
| 2007/0023022 | A1 * | 2/2007 | Lentz | 124/8 |

(Continued)

*Primary Examiner* — Gene Kim
*Assistant Examiner* — Alexander Niconovich
(74) *Attorney, Agent, or Firm* — Dale J. Ream

(57) ABSTRACT

A portable and adjustable clay target launching apparatus for use with a clay pigeon launcher includes a framework. A tilt adjustment assembly is coupled to the framework, and includes a shaft and a tilt assembly input member operatively coupled to the shaft such that the shaft is rotated by operation of the tilt assembly input member. A base member is configured to secure the clay pigeon launching device, the base member being operatively coupled to the shaft and configured to tilt side to side when the shaft is rotated by operation of the tilt assembly input member. A rotational adjustment assembly operatively couples the base member to the tilt adjustment assembly, the rotational adjustment assembly being movable between a released configuration at which the base member is selectively rotatable about a sprocket and a locked configuration at which the base member is not rotatable.

9 Claims, 9 Drawing Sheets

(56) References Cited

U.S. PATENT DOCUMENTS

2010/0282230 A1* 11/2010 Toeckes et al. ..... 124/71
2011/0186023 A1* 8/2011 Callander et al. ..... 124/6
2012/0138034 A1* 6/2012 Whidborne ..... 124/8
2013/0104867 A1* 5/2013 Laporte et al. ..... 124/41.1
2013/0112181 A1* 5/2013 Laporte et al. ..... 124/6
2013/0118464 A1* 5/2013 Laporte et al. ..... 124/42
2013/0118467 A1* 5/2013 Laporte et al. ..... 124/81

* cited by examiner

PORTABLE AND ADJUSTABLE CLAY TARGET LAUNCHING APPARATUS

REFERENCE TO RELATED APPLICATIONS

This application claims the benefit of U.S. application Ser. No. 61/629,800 filed Nov. 29, 2011 that is titled Infinity Trap Base.

BACKGROUND OF THE INVENTION

This invention relates generally to clay target launching devices that are supported on a bumper hitch of a vehicle and, more particularly, to a portable and adjustable clay target launching apparatus that is infinitely adjustable for affecting the trajectory of clay targets launched by a traditional clay target launching device.

Clay target shooting is an enjoyable activity engaged in by many hunters that involves launching a clay target into the air to be shot down or destroyed midair by a shotgun blast. Most clay target launchers, also referred to as clay pigeon launchers, are mounted to a fixed structure such as a spare tire or to a mobile device that gives the launcher some movement so as to alter the flight path of the targets deployed.

Although existing devices and patent proposals are presumably effective for their intended purposes, modifying the position of the launcher so as to vary the flight path of deployed targets is cumbersome and time consuming. In addition, moving the traditional target launcher and its mounting base is difficult and awkward because of weight and size.

Therefore, it would be desirable to have a portable and adjustable clay target launching apparatus that provides virtually infinite adjustability of the trajectory of clay target deployed by a target launcher. Further, it would be desirable to have a portable and adjustable clay target launching apparatus that is easy to position on or off of a vehicle and to move to a desired location.

SUMMARY OF THE INVENTION

A portable and infinitely adjustable clay target launching apparatus for use with a clay pigeon launcher includes a framework. A tilt adjustment assembly is coupled to the framework, the tilt adjustment assembly including a shaft and a tilt assembly input member operatively coupled to the shaft such that the shaft is axially rotated by operation of the tilt assembly input member. A base member is configured to secure the clay pigeon launching device, the base member being operatively coupled to the shaft and configured to tilt side to side when the shaft is rotated by operation of the tilt assembly input member. A rotational adjustment assembly operatively couples the base member to the tilt adjustment assembly, the rotational adjustment assembly being movable between a released configuration at which the base member is selectively rotatable about a sprocket and a locked configuration at which the base member is not rotatable.

Therefore, a general object of this invention is to provide a portable and infinitely adjustable clay target launching apparatus that is configured to receive and secure a clay pigeon launching device and to enable a user to adjust the launching trajectory rotationally, laterally, and vertically.

Another object of this invention is to provide a launching apparatus, as aforesaid, that selectively integrates a clay target launcher to a vehicle, free rolling cart, or stationary mount.

Another object of this invention is to provide a launching apparatus, as aforesaid, having a crank handle operatively connected to a gear train and shaft configured to selectively tilt a base member on which a clay target launching device is mounted.

Still another object of this invention is to provide a launching apparatus, as aforesaid, in which the base member is configured to receive and secure the clay pigeon launcher at a vertically adjustable position.

Yet another object of this invention is to provide a launching apparatus, as aforesaid, having a rotational adjustment assembly that couples the base member to the tilt adjustment assembly and that is movable between a locked configuration at which the base member is not rotatable and a released configuration at which the base member is rotatable.

A further object of this invention is to provide a launching apparatus, as aforesaid, having a framework that is selectively coupled to a vehicle receiver hitch.

A still further object of this invention is to provide a launching apparatus, as aforesaid, in which the framework includes a pair of wheels and is selectively movable whether or not coupled to a vehicle.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
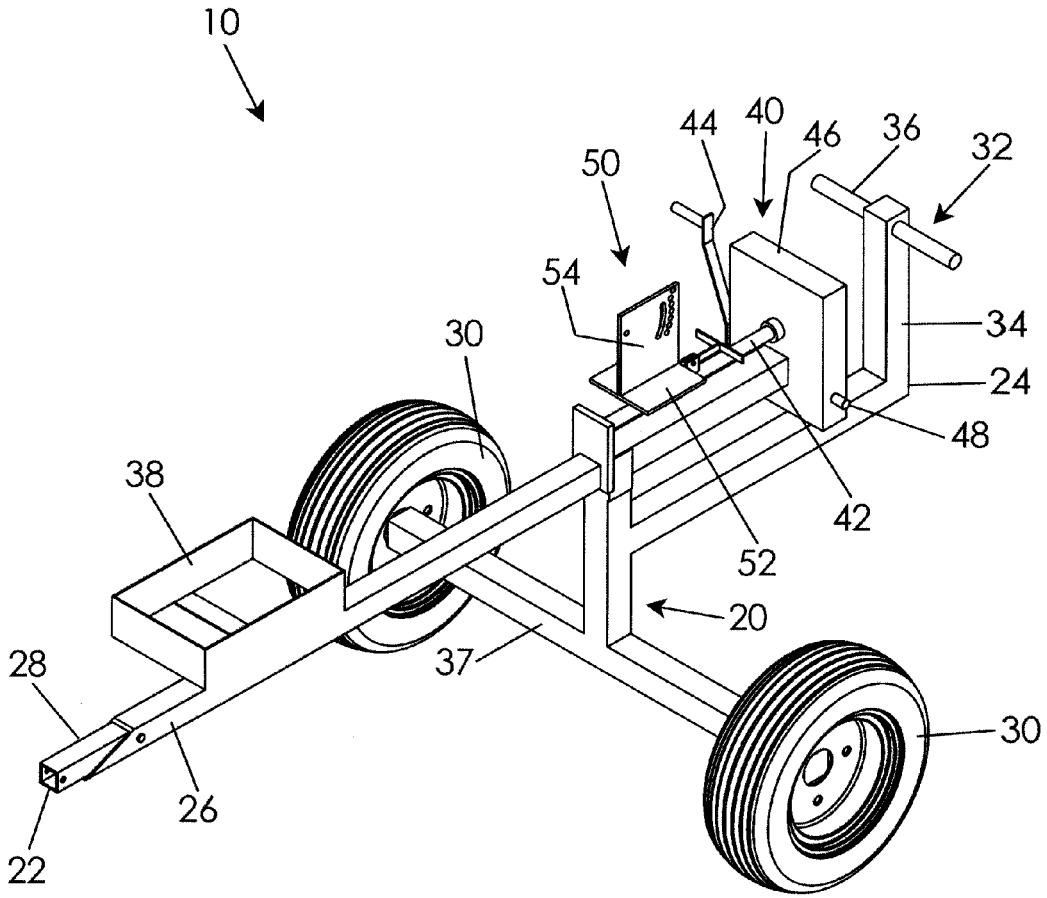
FIG. 1 is a perspective view of a portable and infinitely adjustable clay target launching apparatus according to a preferred embodiment of the present invention.

A portable and infinitely adjustable clay target launching apparatus according to a preferred embodiment of the present invention will now be described with reference to FIGS. 1 to 4 of the accompanying drawings. The launching apparatus 10 includes a framework 20, a tilt adjustment assembly 40, a base member 50, and a rotational adjustment assembly 60.

The framework 20 includes an elongate configuration having a front end 22 and a back end 24. The framework 20 includes structures that connect to a vehicle, embody a free rolling cart, or embody a stationary mount. More particularly, the framework 20 includes a mounting arm 26 coupled to the front end 22 of the framework 20 that extends forwardly therefrom (FIG. 1). The mounting arm 26 includes a hitch portion 28 having a configuration that is complementary to a receiver hitch of a vehicle so as to be selectively coupled thereto. The hitch portion 28 may be coupled to the vehicle hitch when the framework 20 is intended to be used as a rollable cart or as a stationary mount as will be discussed in more detail later. A battery box 38 may be mounted to the framework 20 and configured to receive a battery (not shown) as may be required to energize certain clay target launching devices.

The framework 20 may also be configured as a rollable cart. More particularly, the framework 20 may include a pair of wheels 30 operatively connected by an axle 37 (FIG. 1). In a framework 20 having wheels 30, the framework 20 acts as a cart and may be rolled to a desired position for use. The wheels 30 coupled to the framework 20 make the apparatus 10 portable, such as to be pulled behind an automobile when the mounting arm 26 is coupled to a vehicle receiver hitch.

The framework 20 may also include a handle member 32 adjacent the framework back end 24 (FIG. 1). The handle member 32 may include an upstanding portion 34 extending vertically from the framework 20 and handle grips 36 extending outwardly from the upstanding portion 34 that are configured to be gripped by a user. In use, a user may grasp the grip handles 36 in order to urge the framework 20 forwardly or rearwardly to a desired position. It is understood that the handle member 32 is useful in the embodiment of the framework having wheels 30. The combination of opposed wheels 30 and the rearward handle member 32 make the framework manually portable and movable by a user's manual effort to pull or push it when the mounting arm 26 is not coupled to a vehicle receiving hitch.

Figure 2A:
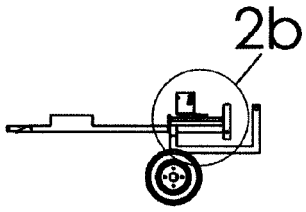
FIG. 2*a* is a side view of the apparatus as in FIG. 1.
Figure 2B:
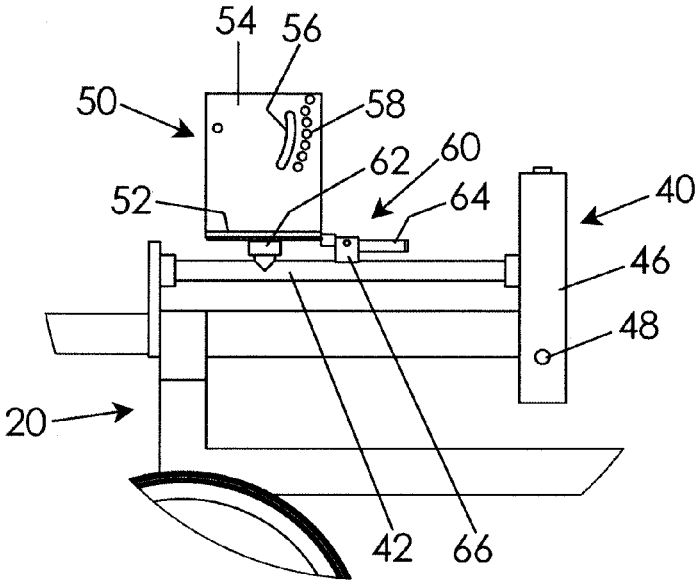
FIG. 2*b* is an isolated view on an enlarged scale taken from FIG. 2*a;*
Figure 3A:
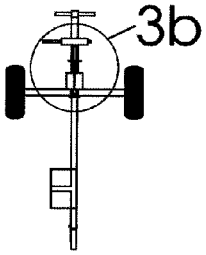
FIG. 3*a* is a top of the apparatus as in FIG. 1.
Figure 3B:
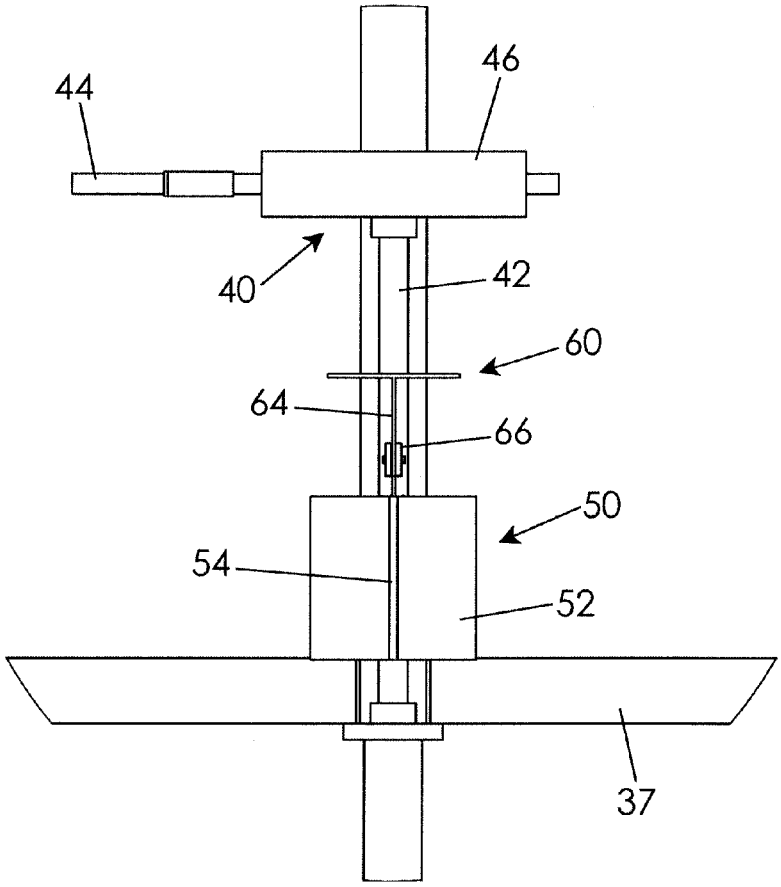
FIG. 3*b* is an isolated view on an enlarged scale taken from FIG. 3*a;*
Figure 4:
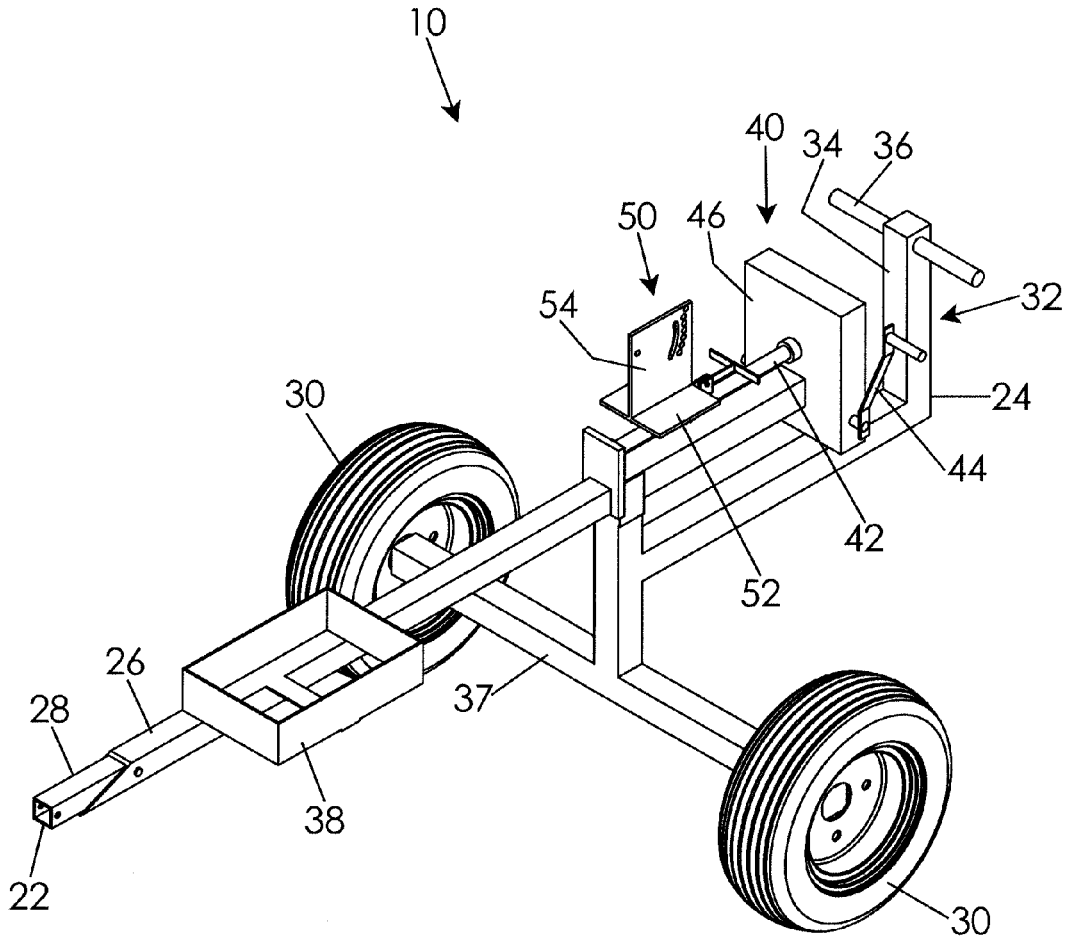
FIG. 4 is another perspective view of the apparatus with a battery box in a alternative configuration and the articulation plate in a locked configuration.
Figure 5A:
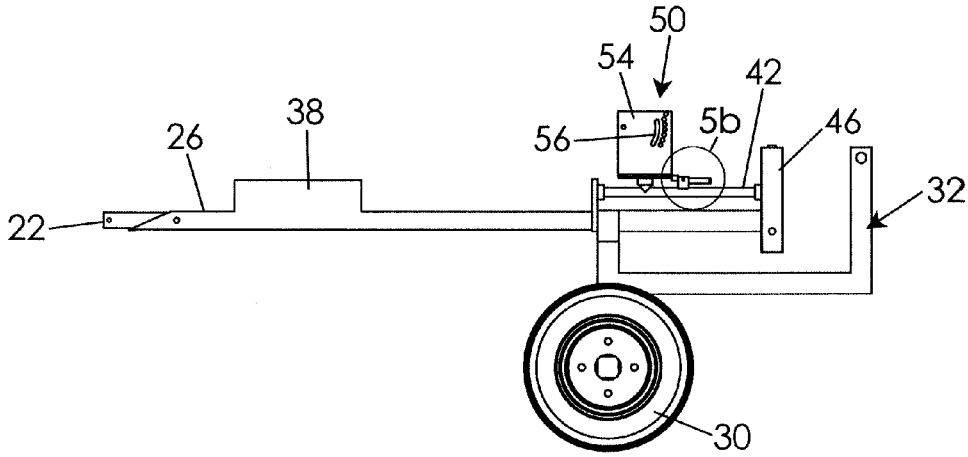
FIG. 5*a* is a side view of the apparatus with a lever of a rotational adjustment assembly in a released configuration.
Figure 5B:
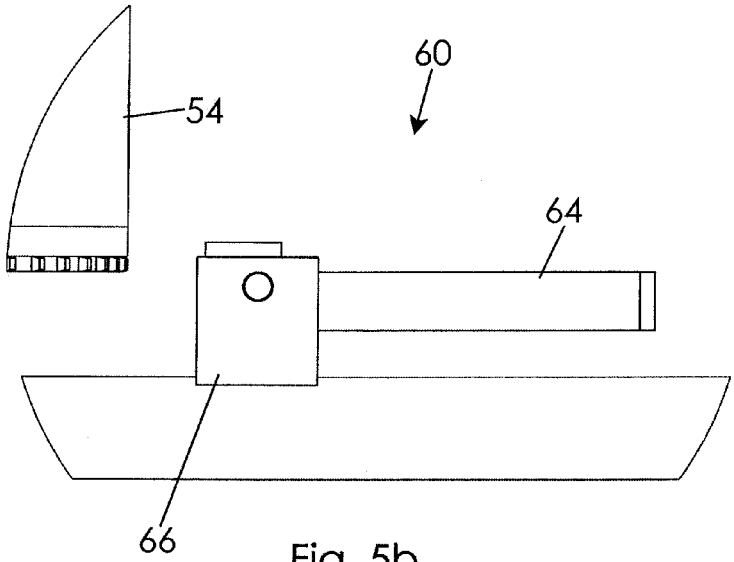
FIG. 5*b* is an isolated view on an enlarged scale taken from FIG. 5*a*.
Figure 6:
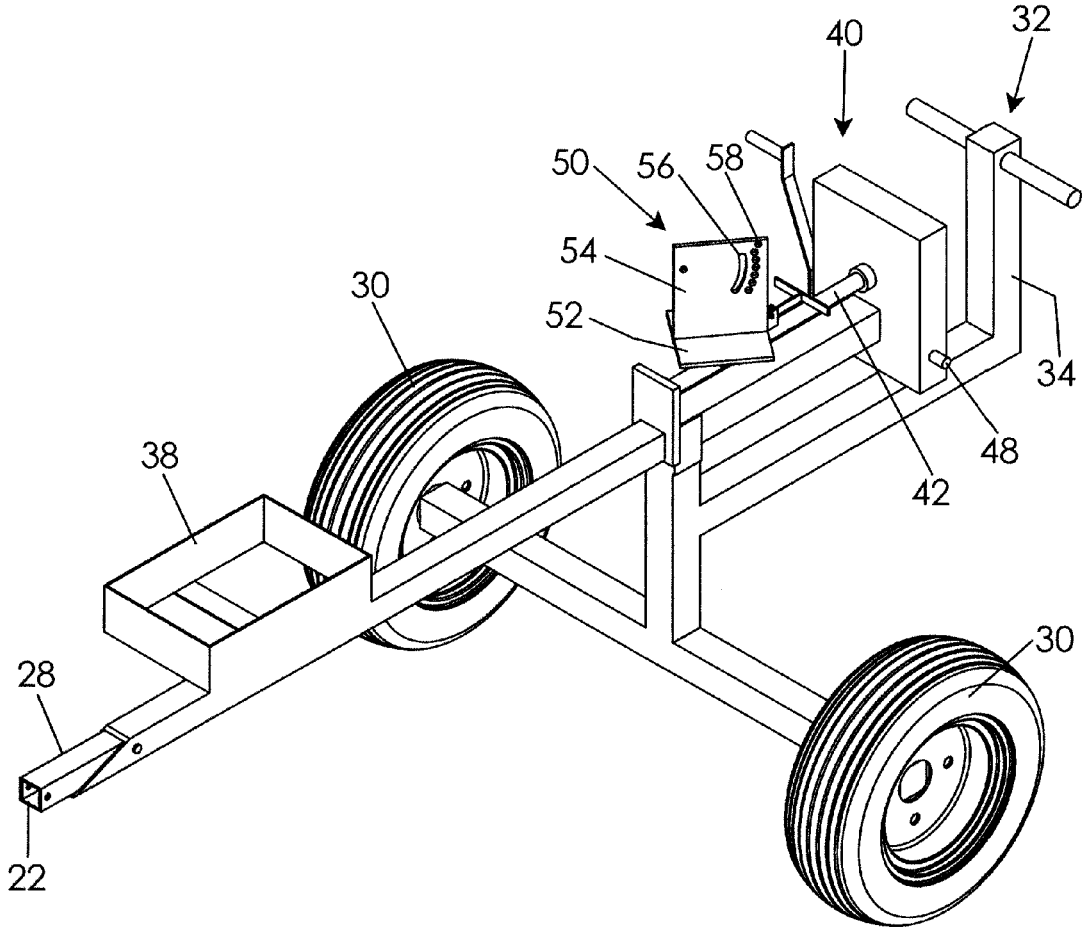
FIG. 6 is a perspective view of the apparatus of FIG. 4 with the articulation plate in a rotated configuration.
Figure 7:
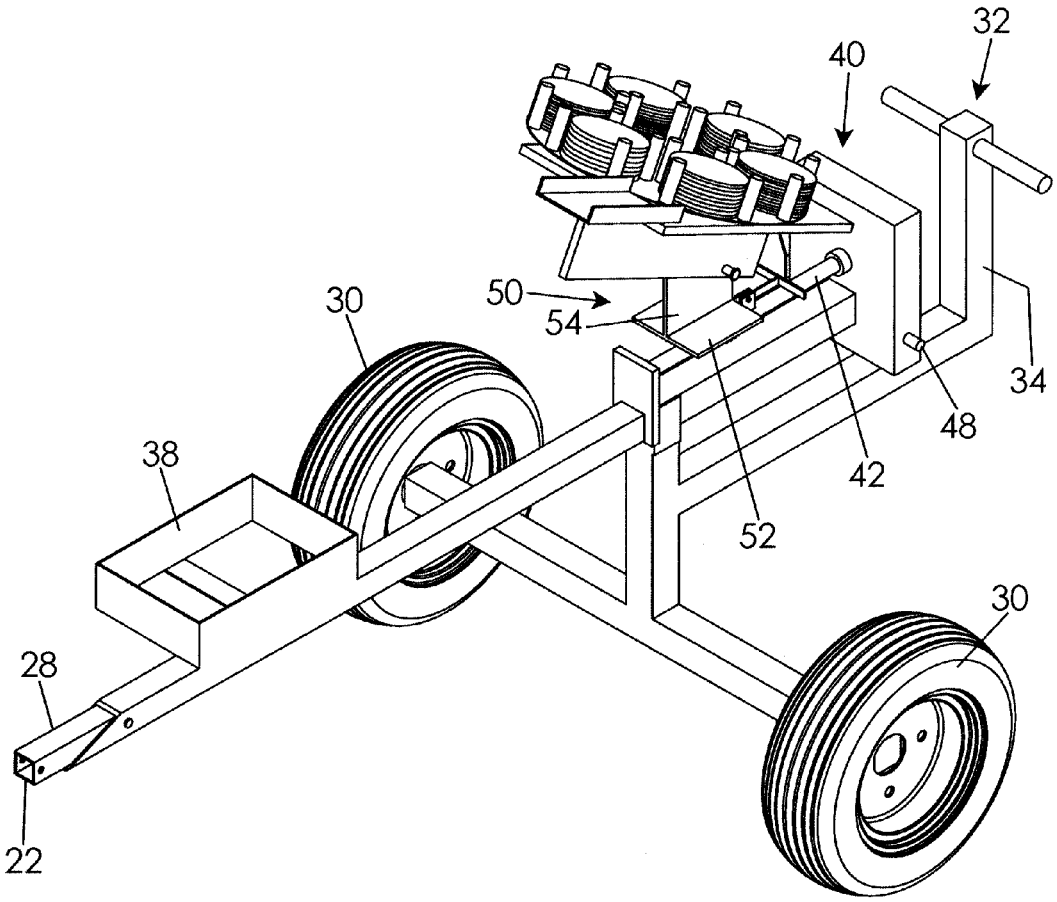
FIG. 7 is a perspective view of the apparatus as in FIG. 4 illustrated with a clay target launching apparatus mounted to the articulation plate.
Figure 8A:
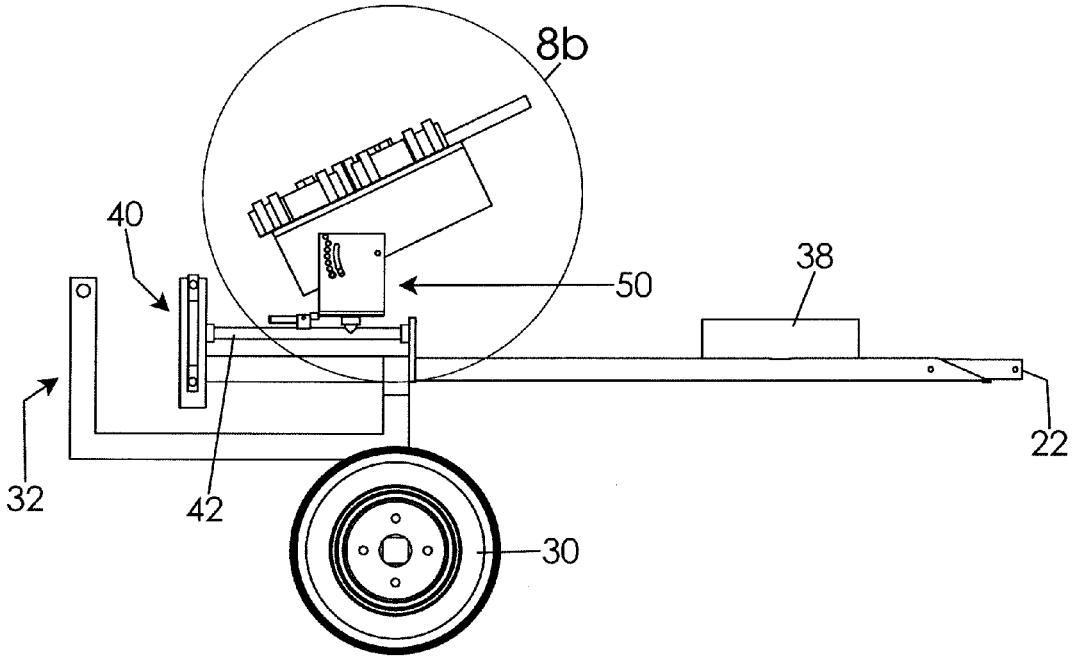
FIG. 8*a* is a side view of the apparatus as in FIG. 7.
Figure 8B:
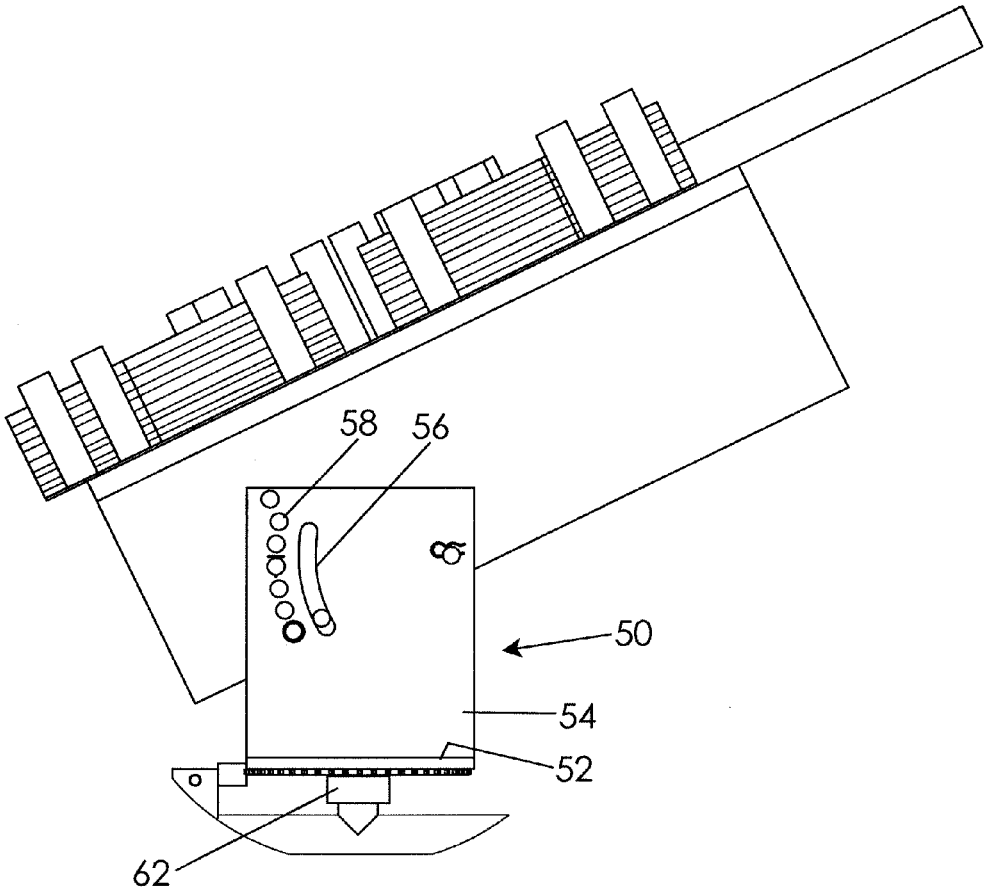
FIG. 8*b* is an isolated view on an enlarged scale taken from FIG. 8*a*.

The tilt adjustment assembly 40 is coupled to the framework 20 (FIGS. 1 and 2*b*). The tilt assembly 40 may include a rotatable shaft 42 operatively coupled to an input member 44 such that said shaft 42 is rotated by operation of the input member 44. More particularly, the tilt adjustment assembly 40 includes a gearbox 46 situated between the input member 44 and the rotatable shaft 42 having an appropriate gear train (not shown) situated therein. The tilt adjustment assembly 40 includes a tilt interface 4 8 configured to releasably connect the tilt adjustment assembly input member 44 to the gearbox 46. The input member 44 may be a crankshaft 42 that, when operated, may impart movement of the gear train which, in turn, may operate the shaft 42 to rotate. Stated another way, rotational movement of the crank handle causes the gear train to transfer energy from the crank handle to the rotatable shaft 42 on the opposite side of the gearbox 46 (FIGS. 1 and 2*b*). The input member 44 is operatively connected to the gearbox 46 with the tilt interface 4 8. In fact, there may be a tilt interface 4 8 on both sides of the gearbox 46 such that the input member 44 may be selectively coupled to either side thereof, as desired by a user.

The base member 50, which may also be referred to as a mounting plate, is configured to receive and secure a traditional clay target launcher or launching device (not shown). The base member 50 is operatively coupled to the shaft 42 and is configured to tilt side to side according to rotation of the shaft 42. For instance, when the shaft 42 is rotated to the left, the base member 50 is tilted to the left; when the shaft 42 is rotated to the right, the base member 50 is tilted to the right. The direction of rotation of the shaft 42 is determined by the direction of rotation of the crank handle/input member 44 described above.

The base member 50 may include an articulation plate 52 and an upstanding wall 54 extending generally upwardly from the articulation plate 52. The articulation plate 52 is normally situated in a generally horizontal position parallel to the ground except when tilted by rotation of the shaft 42 as described above. The upstanding wall 54 may include one or more slots 56 and apertures 58 configured to receive complementary mounting fasteners of a clay target launching device at a height selectable configuration. In other words, the launching device may be coupled to a lower aperture or a higher aperture so as to select the height at which a clay target is launched or simply to be universal to receive different models of launching devices.

The rotational adjustment assembly 60 couples the base member 50 to the tilt adjustment assembly 40. The rotational adjustment assembly 60 may include a sprocket 62 or bearing that is sandwiched between the rotatable shaft 42 and the articulation plate 52 of the base member 50. The sprocket 62 is configured to rotate 360 degrees when pressure is released and to prevent rotation when a predetermined pressure is applied. The rotational adjustment assembly 60 includes a lever 64 coupled to the articulation plate and pivotally coupled to a lever bracket 66, the lever 64 being movable between a released configuration at which the articulation plate is permitted to rotate and an engaged or locked configuration at which the articulation plate is not permitted to rotate. The lever 64 may have a "T" shaped configuration so as to be more easily grasped by a user when moving the lever 64 between released and engaged configurations. Therefore, when the lever 64 is released (i.e. disengaged from the bracket 66), a user may rotate the base member 50 manually to a desired position and, as a result, affect the directional trajectory of a clay target launched from a target launching device coupled to the base member 50.

In use, the portable and adjustable clay target launching apparatus 10 may be positioned at any location desired by a user who desires to engage in shooting clay targets, whether for practice or personal enjoyment. The framework 20 may be positioned in multiple ways. The hitch portion 28 of the mounting arm 26 may be coupled to the receiver hitch of a vehicle. In one embodiment not having wheels 30, the framework 20 may be suspended from the rear of the vehicle during travel and during use. In an embodiment having wheels 30, the framework 20 may be pulled behind the vehicle. In use, the mounting arm 26 may be detached from the vehicle and then moved manually using the handle member 32 or used while still attached to the vehicle receiver hitch.

A traditional clay target launching device may be coupled to the base member 50 as described above and loaded with clay targets, the launching device being height adjustable on the upstanding wall 54 of the base member 50. The clay target launching device may then be oriented and adjusted as desired. Specifically, the input member 44 (crank handle) may be rotated so as to rotate the shaft 42 of the tilt adjustment assembly 40. This action causes the base member 50 to tilt left or right as described above. Further, the rotational adjustment assembly 60 may be adjusted by releasing the lever 64 and then manually rotating the articulation plate 52 of the base member 50.

Accordingly, the portable and adjustable clay target launching apparatus 10 is infinitely adjustable to orient a clay target launching device vertically, side to side, and rotationally so as to provide variation and challenge to a clay target shooting event.

It is understood that while certain forms of this invention have been illustrated and described, it is not limited thereto except insofar as such limitations are included in the following claims and allowable functional equivalents thereof.

The invention claimed is:

1. A portable and infinitely adjustable clay target launching apparatus for use with a clay pigeon launching device, comprising:

a framework; comprising a mounting arm at a proximal end and a protrusion extending vertically from said framework associated with an upstanding protion having a handle grip at a distal end:

a tilt adjustment assembly coupled to said framework, said tilt adjustment assembly including a shaft and a tilt assembly input member operatively coupled to said shaft such that said shaft is axially rotated by operation of said tilt assembly input member;

a base member having an articulation plate situated generally horizontal and parallel to a ground surface and perpendicularly coupled with an upstanding wall defining a plurality of apertures configured to selectively secure one of a plurality of different types of clay 0igeon launching devices at a selectable height and said base member being operatively coupled to said shaft and configured to tilt side to side when said shaft is rotated by operation of said tilt assembly input member; and a rotational adjustment assembly operatively coupling said base member to said tilt adjustment assembly, said rotational adjustment assembly being movable between a released configuration at which said base member is selectively rotatable about a sprocket and a locked configuration at which said base member is not rotatable.

2. The apparatus as in claim 1, wherein said tilt adjustment assembly includes:

a gearbox;

a tilt interface configured to releasably connect said tilt adjustment assembly input member to said gearbox;

wherein:

said gearbox is configured to transfer an input force from said tilt adjustment assembly input member to said shaft;

said tilt adjustment assembly input member is a crank handle.

3. The apparatus as in claim 2, wherein:

said tilt interface includes a first tilt interface situated on a left side of said gearbox and a second tilt interface situated on a right side of said gearbox; and said crank handle is selectively coupled to one of said left side tilt interface and said right side tilt interface.

4. The apparatus as in claim 1, wherein said framework includes a pair of wheels operatively coupled to said framework such that said framework is portable.

5. The apparatus as in claim 4, wherein said framework includes a mounting arm extending forwardly from said framework, said mounting arm configured to be coupled to a vehicle receiver hitch.

6. The apparatus as in claim 1, wherein said framework includes a mounting arm extending forwardly from said framework, said mounting arm configured to be received by a vehicle hitch.

7. The apparatus as in claim 1. wherein said rotational adjustment assembly includes a lever coupled to said articulation plate and pivotally coupled to a lever bracket, said lever being movable between a released configuration at which said articulation plate is permitted to rotate and an engaged configuration at which said articulation plate is not permitted to rotate.

8. The apparatus as in claim 7, wherein said lever includes a T-shaped configuration that is selectively grasped by a user to move said lever between said released configuration and said engaged configuration.

9. The apparatus as in claim 4, further comprising a handle member coupled to a back end of said framework, said handle member being configured such that said framework is selectively movable by a user urging said handle member forwardly or rearwardly.

* * * * *